US005101864A

United States Patent [19]

Shaw

[11] Patent Number: 5,101,864

[45] Date of Patent: Apr. 7, 1992

[54] LOOM GUIDE BAR FOR STRETCHING A FABRIC LATERALLY

[75] Inventor: Henry Shaw, Vleteren, Belgium

[73] Assignee: Picanol N.V. naamloze vennootschap, Belgium

[21] Appl. No.: 622,965

[22] Filed: Dec. 6, 1990

[30] Foreign Application Priority Data

Dec. 7, 1989 [BE] Belgium ..... 08901309

[51] Int. Cl.[5] ..... D03D 49/22

[52] U.S. Cl. ..... 139/307; 26/105; 139/291 R

[58] Field of Search ..... 26/105, 99, 97; 139/311, 291 R, 304, 307

[56] References Cited

U.S. PATENT DOCUMENTS

| | | | |
|---|---|---|---|
| 2,884,015 | 4/1959 | Bechter . | |
| 3,433,430 | 3/1969 | Sprague | 139/311 |
| 3,707,996 | 1/1973 | Zebley et al. | 26/101 |
| 3,753,452 | 8/1973 | Zebley | 139/311 |
| 4,554,714 | 11/1985 | Cho | 26/105 |
| 5,011,060 | 4/1991 | Cramer | 26/105 |

FOREIGN PATENT DOCUMENTS 2304099 9/1973 Fed. Rep. of Germany .

*Primary Examiner*—Andrew M. Falik

*Attorney, Agent, or Firm*—Bacon & Thomas

[57] ABSTRACT

A weaving machine including a device for stretching a fabric in the weaving machine includes a guide bar over which the fabric is bent to thereby bring a surface of the fabric into contact with the guide bar. An array of notches on each end of the guide bar is provided to exert an outward traction on the fabric edges to maintain the fabric in stretched condition. To enable a fabric whose width is narrower than a full weaving width to be located along the guide bar in a non-symmetrical manner while effecting a lateral traction force on the edges of the fabric; the guide bar is provided with at least one array of notches located at one end of the bar arranged so that each notch in the array is broken so as to extend circumferentially less than the full circumference of the guide bar, with the array including a plurality of notches longitudinally and circumferentially spaced along the guide bar. An arrangement is provided to set the notches of the array at a selected one of a plurality of angular positions by rotary movement of the array or the guide bar to thereby define a zone with which the fabric comes into contact at varying distances from the one end of the guide bar, depending upon the rotary position of the guide bar or the array. The array may be disposed helicoidally over the circumference of the guide bar or maybe arranged stepwise along the guide bar length.

7 Claims, 4 Drawing Sheets

Fig. 4
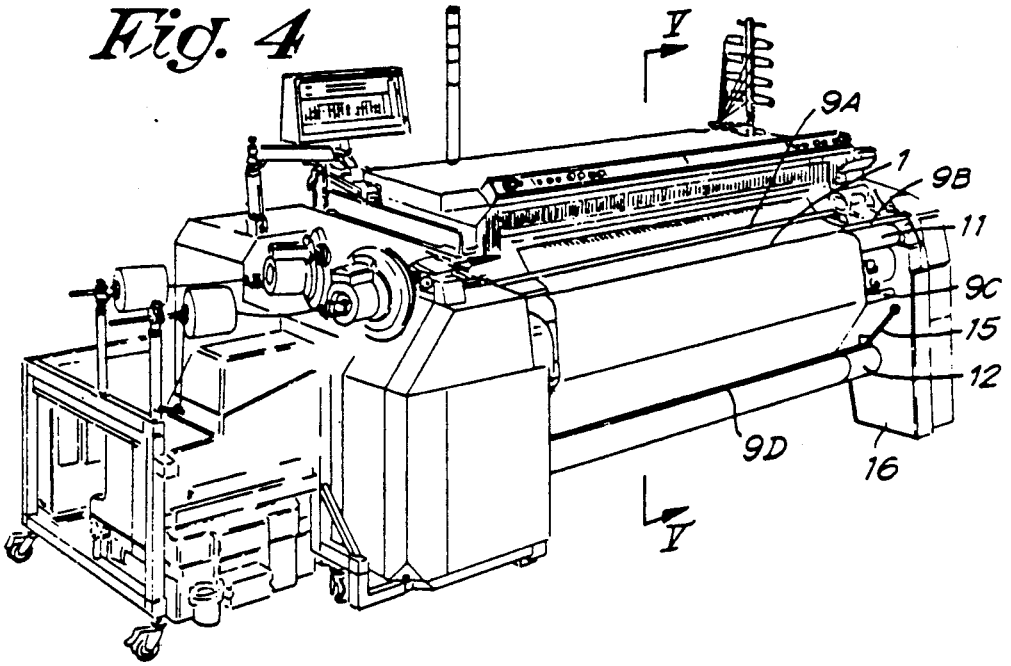
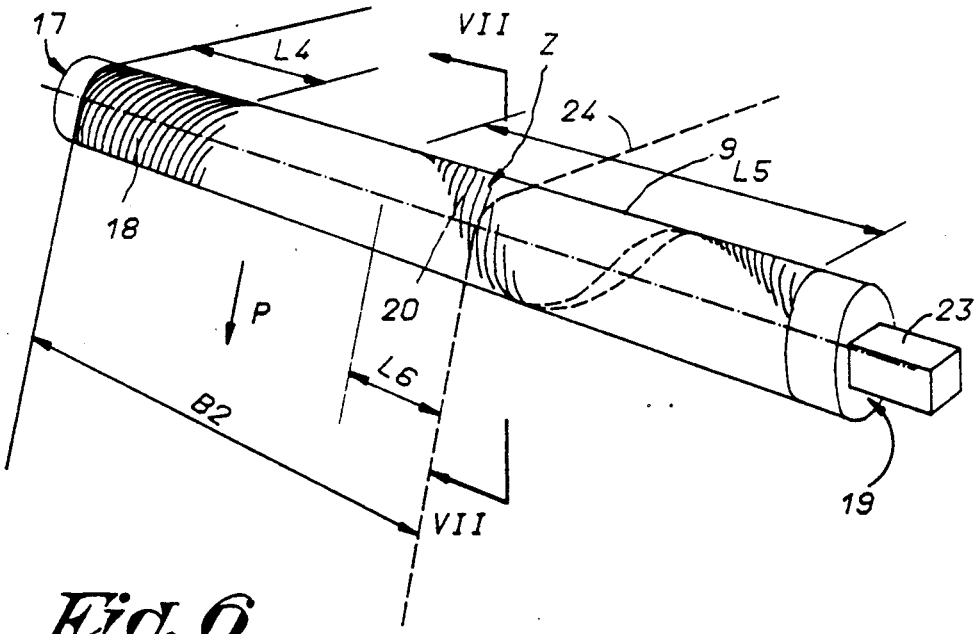
Fig. 6

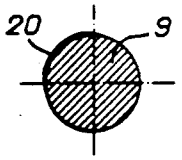
Fig. 7
Fig. 8
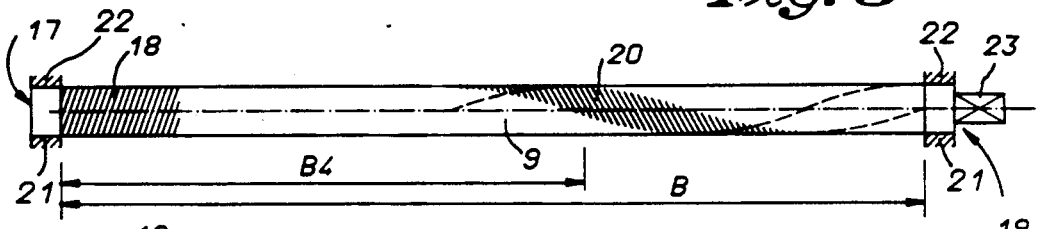
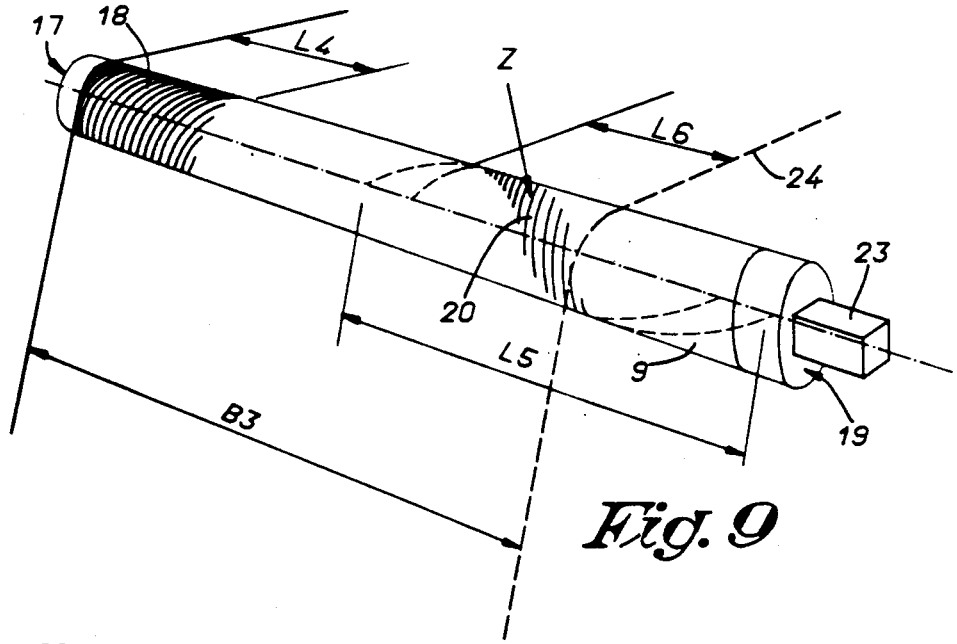
Fig. 9
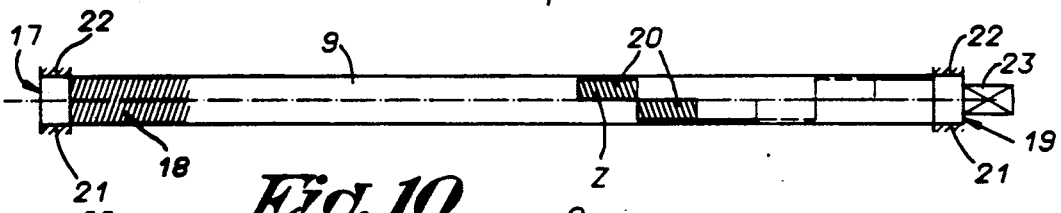
Fig. 10
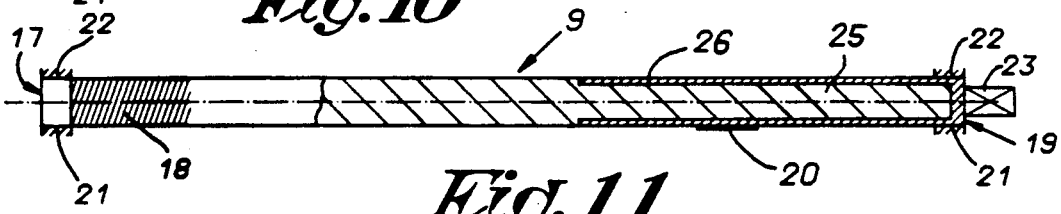
Fig. 11

LOOM GUIDE BAR FOR STRETCHING A FABRIC LATERALLY

BACKGROUND OF THE INVENTION

The present invention concerns a device for stretching the fabric in a weaving machine.

It is known that in a weaving machine the fabric produced between the cloth line and the place where the fabric is taken up tends to contract crosswise.

In order to avoid this concentration, a number of guide bars are provided between the cloth line and the cloth roll, which at their ends have slanting notches over equal lengths in opposite directions in order to exert and outwardly traction on the fabric. These guide bars may be situated on several places and may also serve as temple, breast beam or antifold bar.

The use of these known guide bars, however, has the disadvantage that they do not allow asymmetrical weaving over a limited width of the weaving machine, as in that case there is a greater sideward traction on one side of the fabric than on the other side, which may lead to a faulty take-up of the fabric.

A solution to this problem which allows a fabric to be made whose width is shorter than the weaving width of the weaving machine is provided by leading the fabric symmetrically over the guide bars, such that equal traction is exerted on both sides of the fabric.

However, this known method is difficult to apply in airjet weaving machines, as their main nozzle must remain as close to the fabric edge as possible and as the shift of the main nozzle according to the weft sense, for various reasons including the presence of the reed, is not always possible.

In gripper weaving machines too it is difficult to weave a fabric symmetrically having a smaller width than the weaving width of the weaving machine, because in such machines it is time-consuming or almost impossible to move the device which presents the weft thread.

SUMMARY OF THE INVENTION

The present invention concerns a device for stretching the fabric in a weaving machine which offers a solution to the disadvantage mentioned above whereby, on the one hand, a fabric narrower than the weaving width of the weaving machine is guided asymmetrically along the guide bars while, on the other hand, equal traction is nevertheless obtained on both sides of the fabric.

To this end the invention concerns a device whereby in the known way the fabric is bent over a guide bar in order to bring the fabric into contact with a certain surface of the guide bar and whereby the guide bar has notches at its ends which exert a sideward traction on the fabric, characterized in that, at several distances from a same end of the guide bar, notches have been applied locally along the circumference. The notches can be selectively positioned by a rotary movement to an angle position a zone Z with which the fabric is brought into contact.

In a preferred embodiment the guide bar includes of a cylindrical element which at one end is provided with notches over the entire circumference along a certain distance, while at the other end notches have been applied along a larger distance, which extend helicoidally or almost helicoidally over almost one rotation. The invention has the advantage that the zone, where the notches may be in contact with the fabric, can be moved axially through the rotation of the guide bar.

BRIEF DESCRIPTION OF THE DRAWINGS

In order to better explain the characteristics of the invention, by way of example only and without being limitative in any way, the following preferred embodiments are described with reference to the accompanying drawings, where:

FIG. 4 shows a schematic representation of a weaving machine in perspective, whereby the device according to the invention is applied:

FIG. 6 shows a view in perspective of a guide bar according to the invention;

FIG. 7 shows a cross-section according to line VII—VII in FIG. 6;

FIG. 8 shows a view according to arrow F8 in FIG. 5;

FIG. 9 shows the guide bar of FIG. 6 in another position;

FIG. 10 shows a variant of the invention;

FIG. 11 shows another variant of the invention.

DETAILED DESCRIPTION OF THE PREFERRED EMBODIMENTS

Figure 1:
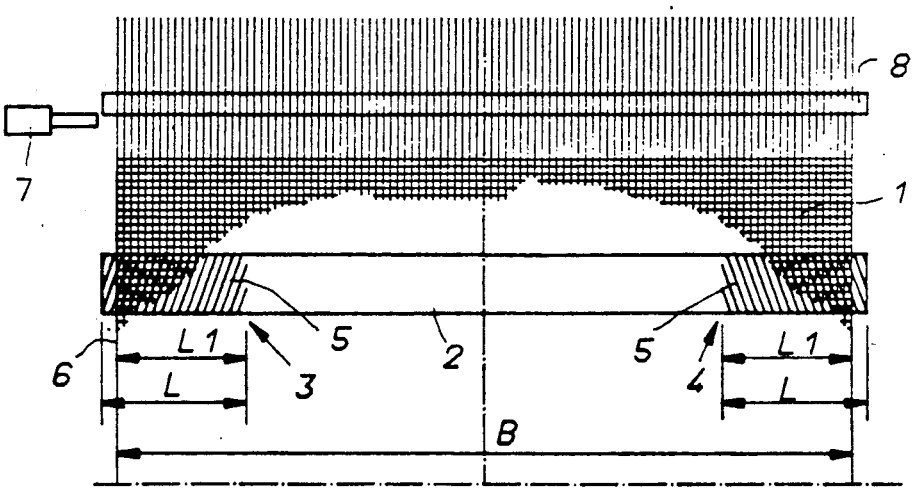
Fig. 1 (PRIOR ART)
FIGS. 1, 2 and 3 show a known device for stretching the fabric in a weaving machine, for several applications.

FIG. 1 schematically shows a fabric 1 whereby a guide bar 2 may be used around which the fabric 1 is bent. Both ends 3 and 4 of the guide bar 2 are provided with notches or ridges 5, applied obliquely and in opposite sense over equal lengths L and over the entire circumference, in the form of, for example, right and left screw-shaped teeth, which exert a sideward traction on the fabric 1.

When, as shown in FIG. 1, the entire weaving width B of the weaving machine is used, the fabric 1 is in contact with the notches 5 at both sides over the same length L1.

Figure 2:
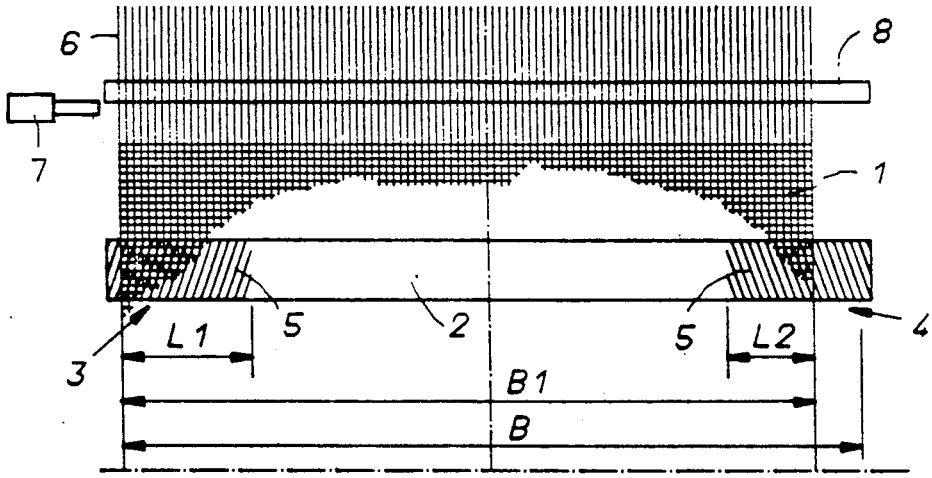
Fig. 2 (PRIOR ART)

However, when, as shown in FIG. 2, the fabric 1 has a width B1 which is smaller than the entire weaving width B and the fabric is woven asymmetrically, it is clear that the fabric 1 is in contact with the notches 5 at one side over length L1, while at the other side it comes only into contact with the notches 5 over a shorter length L2.

As a result, the fabric is clearly pulled to one side, which leads eventually to a faulty cloth take-up.

A possible solution for the problem mentioned above is that, as shown in FIG. 3, the fabric in FIG. 2 is woven symmetrically, such that the fabric 1 comes into contact with the notches 5 of the guide bar 2 at both sides over an equal length L3.

Figure 3:
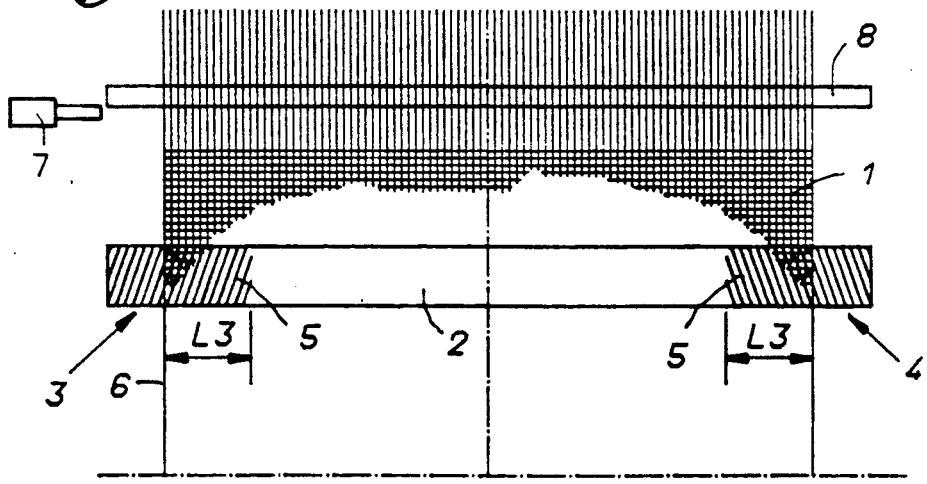
Fig. 3 (PRIOR ART)

However, the solution according to FIG. 3 is not possible for all weaving machines, because in airjet weaving machines for example the fabric edge 6 must be situated directly next to the main nozzle 7. The shift of the main nozzle 7 toward the fabric is thus impossible, because it is impeded by the presence of the reed 8.

The present invention aims to offer a solution to this problem.

Figure 5:
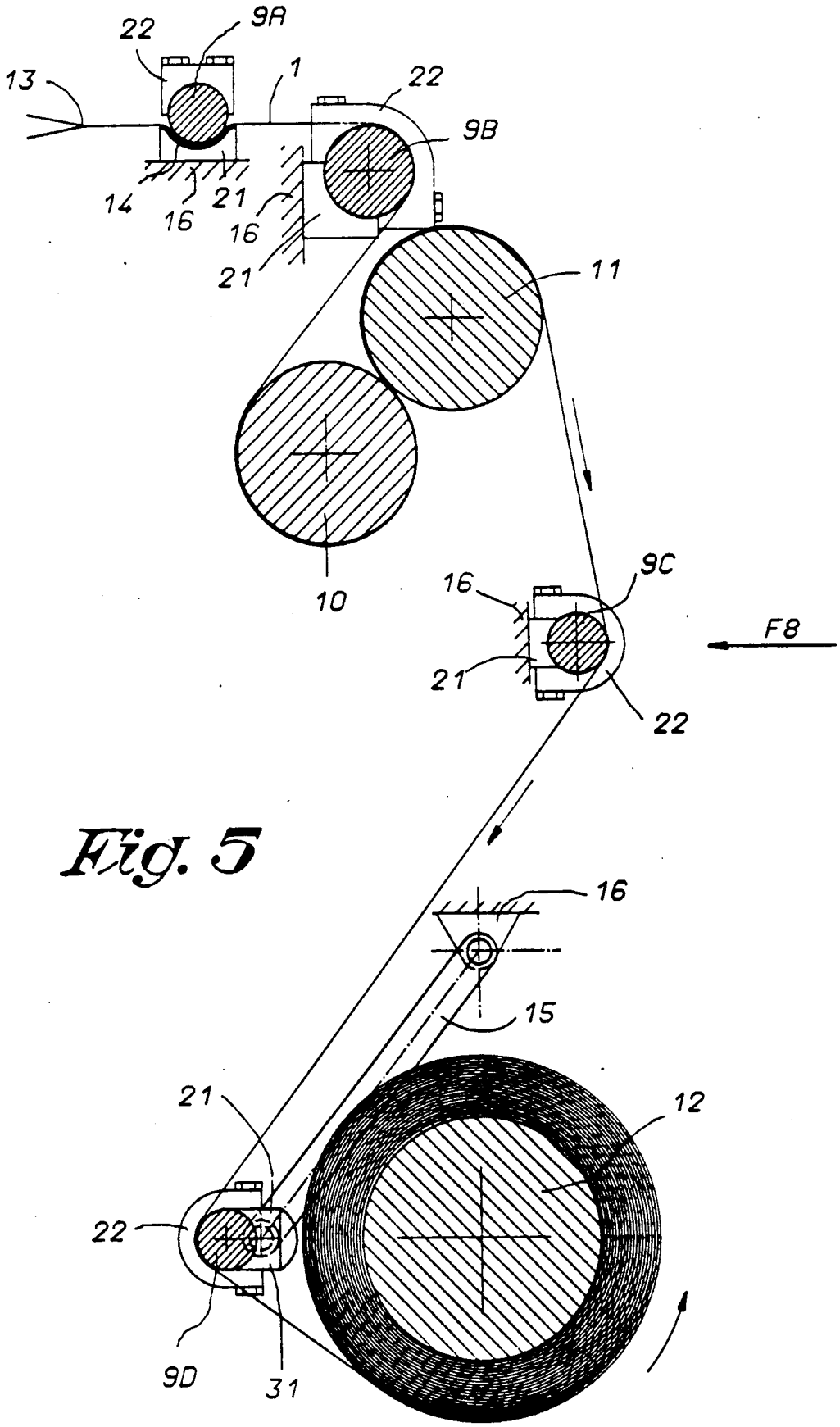
FIG. 5 shows a schematic cross-section according to line V—V in FIG. 4.

FIG. 4 shows a weaving machine whereby the devices for stretching the fabric 1, particularly guide bars 9, are provided on several places, as indicated in FIG. 5 by the guide bars 9A, 9B, 9C and 9C, which act as temple, breast beam, guide element and antifold bar respectively.

The fabric 1 consecutively passes along the guide bar 9A, the breast beam 9B, the sand roller 10, the press roll 11, the guide bar 9C and the guide bar 9D and the finally taken up on the cloth roll 12. The guide bar 9A serving as temple is, as known, placed right behind the cloth line 13 and cooperates in conjunction with a gutter 14.

The guide bar 9D serving as antifold bar keeps the fabric 1 stretched in order to make sure that it is not taken up in a folded form. Such an antifold bar is, as is known, attached to the machine frame 16 in a hingeable manner by means of arms 15.

It is clear that the fabric thereby only comes into contact with a limited surface of the above-mentioned guide bars 9, particularly over an angle smaller than 180 degrees.

In the most preferred embodiment a guide bar 9 is provided at an end 17 over a length L4 and over the entire circumference of the bar with an array of screw-shaped notches 18, while at the other end 19 this guide bar 9 is provided with an array of notches 20 which stretch from the end 19 over a relatively great length L5 according to a helicoidal strip.

In this case the notches 18 are applied as left continuous screw thread while the notches 20 are applied as right broken screw thread in order to cause the fabric 1, which moves according to arrow P, be pulled outward on both sides.

In order to allow the guide bars 9A to 9D to be set and held in the desired angle position, they are preferably mounted in seatings 21, in which they can be tightened by means of clampings 22, as shown in FIGS. 5 and 8.

The guide bars 9A to 9D can for example be provided at one end with a projection 23 which has such a shape, for example square, that a tool can cooperate in conjunction with it to turn the guide bar 9.

The operation of the device can be easily deduced from the two positions in FIGS. 6 and 9, whereby the device for weaving widths B2 and B3 respectively is shown.

As appears from the drawings, the maximum weaving width is equal to B while the minimum weaving width in FIG. 8 is indicated by B4.

It is a clear that a different angular position of a guide bar 9 makes it possible for another zone Z, with notches 20 able to cooperate in conjunction with the fabric 1, to be moved axially as a function of the place of the fabric edge.

It is logical that the fabric edge 24 must come into contact with notches 20 to exert a stretching force on the fabric 1.

The length L4 and the length L6 over which a zone Z stretches axially need not necessarily be equally long to obtain an equally strong traction on the fabric.

This traction is determined at least in part by the surface of the notches 18–20 which come into contact with the fabric 1; by the number of notches 18–20 per surface unit; by the shape of the notches 18–20; by the obliqueness of the notches 18–20 in relation to the sense of the movement of the fabric 1; etc.

It is evident that the zones Z need not be arranged according to a helicoidal strip, but rather may be formed in a different manner with the same purpose, for example by applying notches 20 helicoidally or in steps over the circumference of a guide bar 9, as indicated in FIG. 10.

It is also evident that the guide bar 9 need not necessarily be a one piece cylindrical element in one piece. FIG. 11 shows the cross-section of a variant whereby the guide bar 9 is provided near its end 19 with an element 25 which can rotate ground the axis 25 of the guide bar 9, and which can be set, according to choice, to an angular position by a rotary movement, and which is provided with notches 20 which are applied to the element 26 according to a helicoidal strip or an arrangement in steps.

The present invention is in no way limited to the embodiments described by way of example and shown in the drawings; on the contrary, such a device for stretching a fabric in weaving machines can be made in several variants while still remaining within the scope of the invention.

I claim:

1. In a weaving machine including a device for stretching a fabric in the weaving machine, said device including a guide bar over which fabric is bent in order to bring a certain surface of the fabric into contact with the guide bar, and an array of notches on each end of the guide bar which exerts an outward traction on the fabric edges, the improvement comprising:

at least one of said arrays of notches arranged so that each notch in the array is broken so as to extend circumferentially less than the full circumference of the guide bar, said one array including a plurality of notches longitudinally and circumferentially spaced along the guie bar, and means for setting the notches of said one array at a selected one of a plurality of angular positions by rotary movement of the array in order to define a zone with which the fabric comes into contact, whereby a fabric whose width is narrower than a full weaving width can be located along the guide bar in a non-symmetrical manner to effect a lateral traction force on its edges.

2. The improvement as claimed in claim 1, wherein the device further comprises means including fastenings for allowing said one array of notches to be held in one of said plurality of selected angular positions.

3. The improvement as claimed in claim 2, wherein the fastenings comprise means including seatings and clampings for allowing the guide bar to be clamped at its ends.

4. The improvement as claimed in claim 1, wherein said one array of notches extends helicoidally over a circumference of the guide bar.

5. The improvement as claimed in claim 4, wherein said one array of notches extends along the guide bar in the form of a strip.

6. The improvement as claimed in claim 4, wherein the notches of said one array are arranged in a stepwise sequence.

7. The improvement as claimed in claim 4, wherein each notch of said one array extends approximately over a full circumference of the guide bar.

* * * * *